United States Patent [19]

Newton

[11] Patent Number: 5,041,815

[45] Date of Patent: Aug. 20, 1991

[54] GOLF BAG SECURITY ALARM SYSTEM

[76] Inventor: Ross E. Newton, 5201 E. Saguaro Cir., Phoenix, Ariz. 85044

[21] Appl. No.: 427,461

[22] Filed: Oct. 26, 1989

[51] Int. Cl.[5] ..... G08B 13/14

[52] U.S. Cl. ..... 340/568; 340/571; 340/666

[58] Field of Search ..... 340/568, 571, 666; 206/315.3; 70/64

[56] References Cited

U.S. PATENT DOCUMENTS

| | | | |
|---|---|---|---|
| 4,042,918 | 8/1977 | Klitzman | 340/568 |
| 4,274,088 | 6/1981 | Pierson et al. | 340/568 |
| 4,316,181 | 2/1982 | Primont et al. | 340/571 |
| 4,489,314 | 12/1984 | Miller | 340/568 |
| 4,531,116 | 7/1985 | Takagi et al. | 340/568 |
| 4,538,728 | 9/1985 | Lewis | 206/315.3 |
| 4,716,401 | 12/1987 | Wohlford et al. | 340/568 |
| 4,833,456 | 5/1989 | Heller | 340/571 |

*Primary Examiner*—Glen R. Swann, III
*Assistant Examiner*—Thomas J. Mullen, Jr.
*Attorney, Agent, or Firm*—James F. Duffy

[57] ABSTRACT

What has been disclosed is a golf bag alarm system which actuates an alarm when a thief attempts to remove the golf bag without authorization. In a weight sensitive embodiment of the invention, even the attempt to remove a golf club from the bag will cause the alarm to be sounded. A second embodiment of the invention, sensitive to movement of the bag, will actuate an alarm when the bag is moved from its nominal resting position. The alarm system is portable and may be housed within the golf bag itself or within an associated golf cart. The battery which powers the golf cart may be utilized as the power source for the alarm system carried by the golf cart.

21 Claims, 1 Drawing Sheet

GOLF BAG SECURITY ALARM SYSTEM

BACKGROUND

1. Field of the Invention

The invention relates to anti-theft, security alarm devices. In particular, the invention relates to an alarm system which is triggered by an unauthorized attempt to carry off a golf bag.

2. Prior Art

Resort type living has become a major theme of prominent builders across the country. Housing developments are now planned not only for attractive homes and landscaping but for their added lifestyle amenities as well. Theatres for the performing arts, well equipped arts and craft centers, offices for community endeavors, centers for continuing education, and recreational facilities provide residents with an ongoing challenge to live a rich and fulfilling life. More and more frequently the focus of such developments centers on a golf course to be used primarily by residents of the development. Since many residents of such resort type housing developments are retired, the playing of golf constitutes a major portion of their recreational outlet.

Many resident own and use, frequently, a golf cart to assist them in their excursions about the course. These golf carts frequently find extended use as an aid in pursuing errands throughout the neighborhood. More often than not, one or more golf bags will be found on such golf carts regardless of whether the occupant is playing a round of golf or tending to an errand. Frequently such carts will be parked and left unattended with golf bag and clubs exposed and offering an invitation to persons inclined to thievery. In some areas, the incidence of thefts is looked upon as a plague in light of the numbers of victims produced.

There is a demonstrated need for an alarm system which will be actuated when an unauthorized person attempts to move a golf bag and its contents. It is an object of the present invention to meet this demonstrated need and to do so in a manner which will cause the alarm to sound if even only one golf club is removed from the bag. It is a further intention of the invention that the alarm system shall be transportable either as an integral part of the golf cart or of the golf bag itself.

SUMMARY OF THE INVENTION

A golf bag security alarm system is disclosed and claimed. There is a weight sensitive switch which has a first state of conduction when the gravitational force exerted on a mass is coupled thereto. The switch has a second state of conduction when the gravitational force is removed. Included as part of the invention is a golf bag which has a mass sufficient to place the weight sensitive switch in the first state of conduction when the weight of the bag is coupled to the switch. There is also an alarm circuit which is coupled to the switch and has an alarm to be actuated when the switch is in the second state of conduction and deactuated when the switch is in the first state of conduction.

The system functions by coupling the weight of the golf bag to the switch so as to prevent actuation of the alarm. Then, when the bag is removed, thereby decoupling its weight from the switch, the alarm is actuated. Thus, a thief, unaware of the alarm system, attempting to steal the golf bag, will remove its weight from the switch and cause the alarm to sound.

To establish the operation of the invention with bags of various weight, a weight sensitivity control is coupled to the weight sensitive switch to permit the switch to go into its first state of conduction when a bag of a selected, minimum weight is coupled thereto.

A hidden switch is coupled to the alarm circuit to arm the circuit when the operator/golfer intends to leave the bag unattended, and thus, subject to theft. The arming switch, of course, disarms the alarm circuit while the golfer is actively utilizing the golf bag and the clubs may be carried therein.

When a thief attempts to steal the golf bag, he removes it weight from the weight sensitive switch and causes the alarm to be activated. His first reaction may well be to release the bag and allow its weight to settle back onto the weight sensitive switch. To prevent this involuntary action from causing the alarm to be deactivated, a latching switch is coupled into the alarm circuit to maintain the alarm actuated until the circuit is disarmed by operation of the arming switch.

For complete portability the alarm circuit is powered by a self contained transportable power source. In a first embodiment of the invention disclosed herein, there is a housing coupled to the golf bag to house the power source and the alarm circuit. This permits the alarm system to be transported with the golf bag. Weight of the bag is coupled to the weight sensitive switch when the bag is positioned to achieve this end, for example, when the bag stands upright. In this embodiment of the invention the transportable power source is a battery.

In a second disclosed embodiment of the invention, a golf cart is provided which has the alarm circuit coupled to it to be transported with the golf cart. The cart includes means for transporting the golf bag in a manner which permits its weight to be coupled to the weight sensitive switch. This arrangement permits the system to be armed such that the alarm will sound if the weight is decoupled from the weight sensitive switch.

In the embodiment of the invention which utilizes a golf cart, the self contained, transportable power source is a battery which is further coupled to the golf cart to power the cart.

Another embodiment substitutes a movement sensing switch for the weight sensitive switch.

A DETAILED DESCRIPTION OF THE INVENTION

Figure 1:
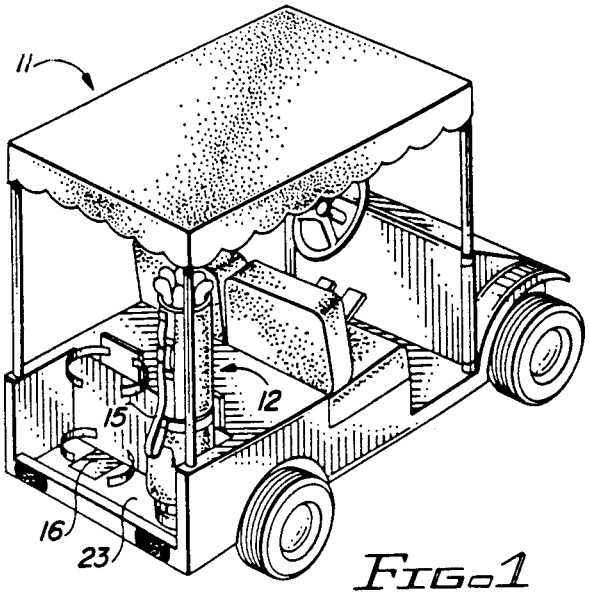
FIG. 1 illustrates a golf cart with a golf bag and clubs in place thereon.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

In FIG. 1 is illustrated the opportunity which is often presented to a thief. An electric golf cart 11 having a golf bag 12 with golf clubs and other paraphernalia therein is left unattended. A thief may casually lift the bag 12 from golf cart 11 and walk away with $1,500 or more of golfing items. Such thefts frequently occur while golf cart 11 is parked at the club house of the golf course. Also, thefts occur when the golf cart 11 is parked in private driveways, in unlocked garages, or in parking lots of shopping centers. The following disclosure will present a scheme whereby the unauthorized lifting of the golf bag 12 will cause an alarm to be actuated to alert others in the vicinity that a theft is being attempted.

Figure 2:
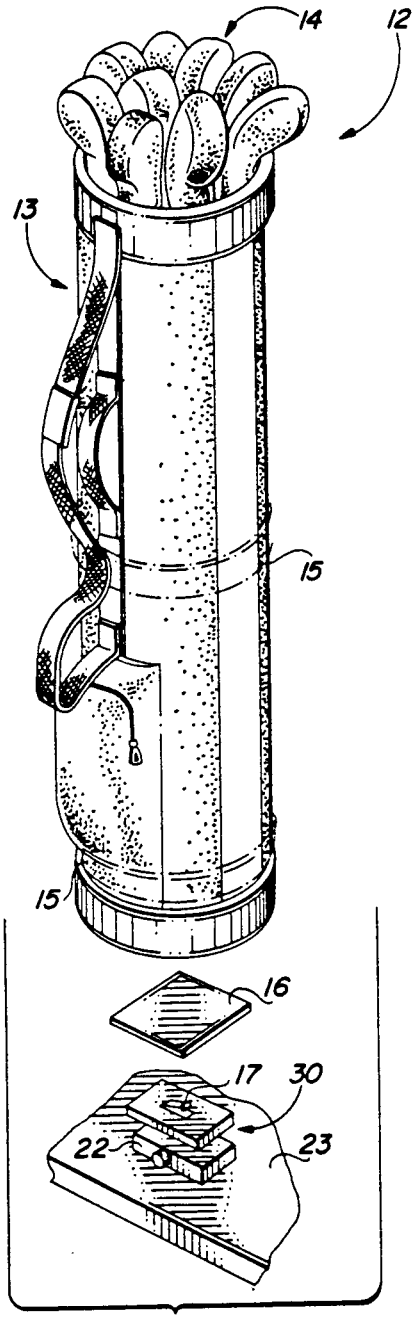
FIG. 2 illustrates the cooperative relationship between golf bag and alarm system wherein the weight of the bag is coupled to the actuating switch of the alarm system.

With reference to FIG. 2, the golf bag 12 comprises the container 13, golf clubs 14 and any additional paraphernalia which may be stored by the golfer within container 13. When transported by golf cart 11, bag 12 will generally be maintained in an upright position by means of supports 15 which are coupled to the cart 11, not shown in FIG. 2. In a presently preferred embodiment of the invention, a weight sensitive switch 17 is weight-coupled to the mass of bag 12. In general, coupling will be through a pressure plate 16 which may be a portion of the floor plate or rug covering of golf cart 11 or, in an alternative embodiment of the invention, the bottom of bag 12. The weight (WGT) of bag 12 is coupled through pressure plate 16 to switch 17. Switch 17 is, in turn, coupled to a support 23 to enable the switch to react to the gravitational force, that is, the weight of bag 12, produced by the mass of bag 12. Support 23 may, depending upon the embodiment in which the invention is employed, be a portion of golf cart 11 or a part of the housing in which the alarm system is housed and coupled to bag 12.

Certain weight sensitive switches, such as switch 17, may be adjusted to be actuated at selected levels of weight coupled to the switch. Sensitivity may sometime be adjusted by a physical displacement of switch 17 to draw it closer to or further from pressure plate 16. Alternatively, switch 16 is electrically adjusted to the desired degree of sensitivity. Both of these approaches to control sensitivity are well known to those skilled in the art and the sensitivity adjustment 22, shown in FIG. 2 coupled to switch 17, is intended to represent either type of sensitivity adjustment or any other type which may be available.

In operation, the mass of bag 12 is placed atop pressure plate 16. The gravitational force, that is the weight of the bag, actuates microswitch 17 to place it in a first state of conduction, one in which no current flows, in preparation for arming the alarm system. When the alarm system is armed, removal of the weight from the pressure plate will cause microswitch 17 to move to a second state of conduction, that is one in which current flows, causing an alarm to be actuated.

The word "alarm" here is used in a generic sense. The actuation of the alarm will produce an audible or visual signal or any other type of attractive signal which will alert persons in the vicinity that a theft is being attempted.

Figure 3:
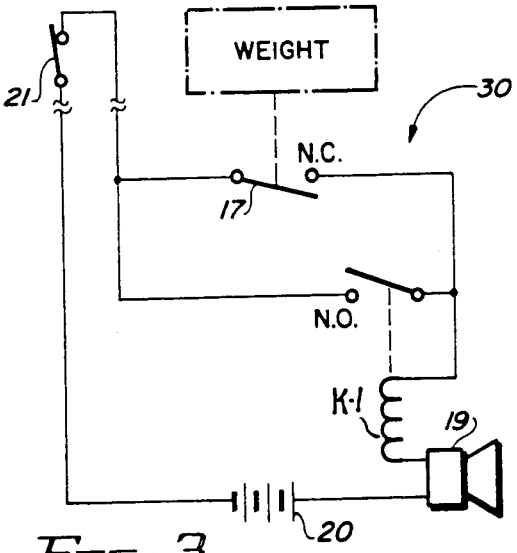
FIG. 3 is a schematic drawing which meets the functional needs of the alarm system.

A schematic embodying the invention is shown in FIG. 3. The alarm system 30 will cause the actuation of an alarm when an attempted theft is perpetrated of a golf bag. While the schematic of FIG. 3 will perform the functions disclosed herein, it is not intended that this circuit be taken as a limitation as to the manner in which the invention may be embodied. The schematic of FIG. 3 is offered for expository purposes.

In a presently preferred embodiment of the invention, the weight (WGT) of golf bag 12 will cause weight sensitive switch 17 to be placed in a non-conducting state. Removal of the weight (WGT) will permit switch 17 to go into a second conduction state wherein current flow through the switch is permitted. Current will flow through switch 17 to actuate a sensible alarm, here illustrated as a horn 19. Alarm circuit 30 is powered by a power source, illustrated as battery 20.

An arming switch 21 permits the alarm system 30 to be armed so as to sound an alarm when the weight (WGT) is removed from switch 17 or to inhibit the sounding of that alarm at such times as may be selected by the operator. Thus, while golf bag 12 is being utilized by a golfer, arming switch 21 would be placed in the open position so that removal of golf clubs from bag 12 will not actuate switch 17 so as to sound an alarm. In practice, arming switch 21 will be placed in a nonconspicuous position so that a thief will not be readily able to disable the alarm system.

If one considers that a thief in lifting golf bag 12, or extracting one or more of the clubs 14 therefrom, will be startled by the sounding of the alarm and thereafter release his grip on bag 12 causing its weight to be applied to switch 17 to again place switch 17 in the nonconductive state, the alarm might be terminated before attention is called to the thieving activity. To prevent the alarm from being disabled by the release of golf bag 12 current will flow not only through horn 19, but will also flow through relay K-1. Relay K-1 causes the contacts of switch 18 to close and remain so until the golfer purposefully opens arming switch 21. Thus, once the weight of bag 12 has been lifted from switch 17 so as to cause the alarm to sound, replacement of the weight on switch 17 will not disable the alarm. The alarm will continue to sound until switch 18 is disabled by the golfer. The continuing alarm will draw attention to the thief and encourage his rapid departure from the vicinity without golf bag 12 in his possession.

Figure 4:
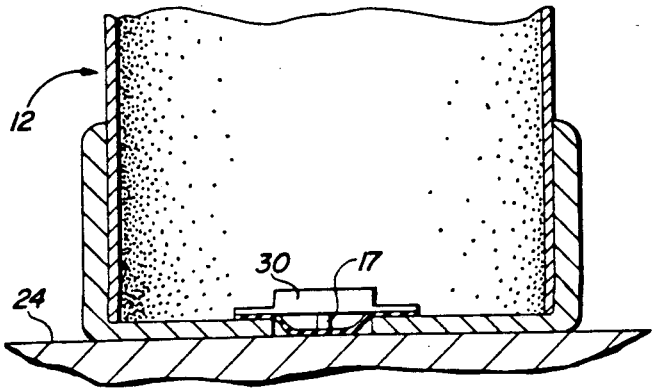
FIG. 4 illustrates a golf bag having the alarm system integral thereto.

Alarm system 30 may be emplaced in a housing comprised of part of the structure of golf cart 11, as suggested in FIG. 2. Alternatively, alarm system 30 may be housed within golf bag 12 as indicated in FIG. 4 and suggested earlier in the discussion herein. In FIG. 4, pressure plate 16 of FIG. 2, comprises the base of the bag 12. Bag 12 stands upright on its base, the gravitational force of its mass is transmitted through the base, pressure plate 16, to switch 17.

Figure 5:
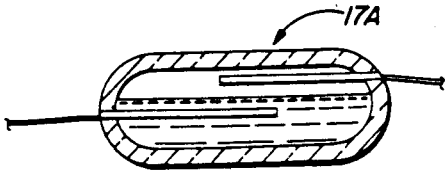
FIG. 5 shows a movement sensing switch.

An alternative embodiment of the invention causes alarm 30 to be actuated in response to movement of golf bag 12. In this embodiment, switch 17 of FIG. 3 is replaced by switch 17A of FIG. 5. Switch 17A is a motion sensitive switch, for example, a mercury switch. Switch 17A may be oriented to a selected nominal position of bag 12, for example, an upright position of bag 12 when it stands alone or a slanted position when bag 12 is positioned within a golf cart, not shown. Tipping bag 12 from either of these nominally selected positions will cause switch 17A to move into a conduction state wherein current flows through switch 17A. Thereafter, the operation of the circuit is the same as earlier described with respect to FIG. 3.

What has been disclosed is a golf bag alarm system which actuates an alarm when a thief attempts to remove the golf bag without authorization. In a weight sensitive embodiment of the invention, even the attempt to remove a golf club from the bag will cause the alarm to be sounded. A second embodiment of the invention, sensitive to movement of the bag, will actuate an alarm when the bag is moved from its nominal resting position. The alarm system is portable and may be housed within the golf bag itself or within an associated golf cart. The battery which powers the golf cart may be utilized as the power source for the alarm system carried by the golf cart.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may understand and practice the invention, that which is claimed is:

1. A golf bag security alarm system comprising:

a weight sensitive switch having a first state of conduction when the gravitational force exerted on a mass is coupled thereto and a second state of conduction when said gravitational force is decoupled therefrom;

a golf bag having a mass sufficient to place said switch in said first state of conduction when the weight of said bag is coupled to said switch;

an alarm circuit coupled to said switch and having an alarm which is actuated when said switch is in said second state of conduction and deactuated when said switch is in said first state of conduction, whereby coupling the weight of said golf bag to said switch prevents actuation of said alarm and decoupling the weight of said golf bag from said switch permits actuation of said alarm.

2. The alarm system of claim 1 further comprising weight sensitivity control means coupled to said weight sensitive switch for selectively establishing the minimum mass which when weight coupled to said switch will produce said first state of conduction in said switch.

3. The alarm system of claim 1 further comprising an arming switch coupled to said alarm circuit so as to selectedly permit and inhibit actuation of said alarm.

4. The alarm system of claim 1 further comprising a latching switch coupled to said alarm circuit and actuated when said weight sensitive switch changes from its first conduction state to its second conduction state as a result of a decoupling of the weight of said bag from said weight sensitive switch, whereby said alarm remains actuated regardless of the weight of said bag being again coupled to said weight sensitive switch so as to place said weight sensitive switch in its first conduction state again.

5. The alarm system of claim 4 further comprising an arming switch coupled to said alarm circuit so as to selectedly permit and inhibit actuation of said alarm.

6. The alarm system of claim 5 further comprising weight sensitivity control means coupled to said weight sensitive switch for selectively establishing the minimum mass which when weight coupled to said switch will produce said first state of conduction in said switch.

7. The alarm system of claim 1 further comprising a self contained power source coupled to said alarm circuit and transportable therewith.

8. The alarm system of claim 7 further comprising weight sensitivity control means coupled to said weight sensitive switch for selectively establishing the minimum mass which when coupled to said switch will produce said first state of conduction in said switch.

9. The alarm system of claim 8 further comprising a latching switch coupled to said alarm circuit and actuated when said weight sensitive switch changes from its first conduction state to its second conduction state as a result of a decoupling of the weight of said bag from said weight sensitive switch, whereby said alarm remains actuated regardless of the weight of said bag being again coupled to said weight sensitive switch so as to place said weight sensitive switch in its first conduction state again.

10. The alarm system of claim 7 further comprising said power source and said alarm circuit housed in said golf bag and transportable with said bag, the weight of said bag being coupled to said weight sensitive switch by the selected positioning of said bag.

11. The alarm system of claim 10 further comprising weight sensitivity control means coupled to said weight sensitive switch for selectively establishing the minimum mass which when weight coupled to said switch will produce said first state of conduction in said switch.

12. The alarm system of claim 10 wherein said self contained transportable power source is a battery.

13. The alarm system of claim 10 further comprising a latching switch coupled to said alarm circuit and actuated when said weight sensitive switch changes from its first conduction state to its second conduction state as a result of a decoupling of the weight of said bag from said weight sensitive switch, whereby said alarm remains actuated regardless of the weight of said bag being again coupled to said weight sensitive switch so as to place said weight sensitive switch in its first conduction state again.

14. The alarm system of claim 13 further comprising weight sensitivity control means coupled to said weight sensitive switch for selectively establishing the minimum mass which when weight coupled to said switch will produce said first state of conduction in said switch.

15. The alarm system of claim 7 further comprising a golf cart having said alarm circuit coupled thereto for transport with said golf bag, said golf bag being in weight coupled relationship to said weight sensitive switch and said weight sensitive switch being thereby in said first state of conduction.

16. The alarm system of claim 15 further comprising weight sensitivity control means coupled to said weight sensitive switch for selectively establishing the minimum mass which when weight coupled to said switch will produce said first state of conduction in said switch.

17. The alarm system of claim 15 wherein said self contained transportable power source is a battery further coupled to said golf cart to power same.

18. The alarm system of claim 15 further comprising a latching switch coupled to said alarm circuit and actuated when said weight sensitive switch changes from its first conduction state to its second conduction state as a result of a decoupling of the weight of said bag from said weight sensitive switch, whereby said alarm remains actuated regardless of the weight of said bag being again coupled to said weight sensitive switch so as to place said weight sensitive switch in its first conduction state again.

19. The alarm system of claim 18 further comprising weight sensitivity control means coupled to said weight sensitive switch for selectively establishing the minimum mass which when weight coupled to said switch will produce said first state of conduction in said switch.

20. A golf bag security alarm system comprising:

a golf bag;

a switch affixed to said bag and actuated by movement of said bag; and an alarm circuit coupled to said switch having an alarm which is actuated upon actuation of said switch by movement of said golf bag.

21. A golf bag security alarm system comprising:

a golf bag;

a switch coupled to said bag and actuated by movement of said bag;

an alarm circuit coupled to said switch having an alarm which is actuated upon actuation of said switch by movement of said golf bag; and a latching switch coupled to said alarm circuit for maintaining said alarm in an actuated state after said alarm is first actuated by movement of said golf bag.

* * * * *